US009702603B2

(12) United States Patent
Li

(10) Patent No.: US 9,702,603 B2
(45) Date of Patent: Jul. 11, 2017

(54) REFRIGERATION SYSTEM FOR A REFRIGERATOR APPLIANCE

(71) Applicant: General Electric Company, Schenectady, NY (US)

(72) Inventor: Jianwu Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 602 days.

(21) Appl. No.: 14/148,789

(22) Filed: Jan. 7, 2014

(65) Prior Publication Data

US 2015/0192341 A1 Jul. 9, 2015

(51) Int. Cl.

| | |
|---|---|
| ***F25B 47/02*** | (2006.01) |
| ***F25D 11/02*** | (2006.01) |
| ***F25D 21/08*** | (2006.01) |

(52) U.S. Cl.

CPC ..... *F25B 47/02* (2013.01); *F25D 11/022* (2013.01); *F25D 21/08* (2013.01); *F25B 2347/022* (2013.01); *F25B 2600/2511* (2013.01); *F25D 2700/12* (2013.01); *F25D 2700/122* (2013.01)

(58) Field of Classification Search

CPC . F25D 11/022; F25B 2347/022; F25B 47/022
See application file for complete search history.

(56) References Cited

U.S. PATENT DOCUMENTS

| | | | | |
|---|---|---|---|---|
| 3,537,274 | A | 11/1970 | Tilney | |
| 4,328,681 | A * | 5/1982 | Sakamoto | F25C 1/147 62/157 |
| 6,067,815 | A * | 5/2000 | James | F25B 5/02 165/10 |
| 7,475,557 | B2 * | 1/2009 | Yoshioka | F25B 1/10 62/175 |
| 7,698,902 | B2 | 4/2010 | Kang et al. | |
| 8,250,875 | B2 * | 8/2012 | Rafalovich | F25B 5/02 62/151 |
| 2010/0192622 | A1 | 8/2010 | Oh et al. | |
| 2010/0287961 | A1 * | 11/2010 | Song | F25B 5/04 62/81 |

* cited by examiner

*Primary Examiner* — Allen Flanigan
*Assistant Examiner* — Filip Zec
(74) *Attorney, Agent, or Firm* — Dority & Manning, P.A.

(57) ABSTRACT

Refrigeration systems and refrigerator appliances are provided. A refrigeration system includes a compressor for compressing a refrigerant, a first evaporator, and a second evaporator. The refrigeration system further includes a conduit for flowing the refrigerant through one of the first evaporator or the second evaporator, the conduit configured around the other of the first evaporator or the second evaporator such that heat exchange occurs between the refrigerant flowing through the conduit and the other of the first evaporator or the second evaporator.

20 Claims, 3 Drawing Sheets

FIG. —1—

REFRIGERATION SYSTEM FOR A REFRIGERATOR APPLIANCE

FIELD OF THE INVENTION

The subject matter of the present disclosure relates generally to refrigerator appliances, and more particularly to refrigeration systems having multiple evaporators for use with refrigerator appliances.

BACKGROUND OF THE INVENTION

A commonly available design for a refrigeration appliance, particularly one for consumer use, includes a cabinet that contains a freezer compartment and a fresh food compartment. These compartments may be arranged e.g., side by side or may include one positioned over the other. Refrigeration systems are typically utilized to cool the compartments.

In one example of a conventional design, the evaporator of a refrigeration system is positioned in the freezer compartment where a fan moves air in the freezer compartment across the evaporator to freeze the contents of the freezer compartment. A damper positioned between the freezer compartment and the fresh food compartment is used to feed a portion of the air over to the fresh food compartment for cooling its contents. In another example of a conventional design, a refrigeration system may utilize multiple evaporators, such as an evaporator to freeze the contents of the freezer compartment and an evaporator to cool the contents of the fresh food compartment.

Presently known multiple evaporator systems can, however, have disadvantages. For example, when one or both evaporators are off, frost can accumulate on the evaporator(s). This frost can reduce the efficiency of the associated evaporator. One effort to reduce or eliminate frost has been to utilize a heater, such as an electric heater, to heat the evaporator(s) when they are not operating. However, the addition of a heater to the system adds cost and complexity to the system, and increases the energy consumption of the system.

Accordingly, improved refrigerator appliances and refrigeration systems therefore are desired. In particular, cost- and energy-effective refrigerator appliances and refrigeration systems which reduce evaporator frost build-up would be advantageous.

BRIEF DESCRIPTION OF THE INVENTION

In one embodiment, a refrigeration system for a refrigerator appliance is disclosed. The refrigeration system includes a compressor for compressing a refrigerant, a first evaporator, and a second evaporator. The refrigeration system further includes a conduit for flowing the refrigerant through one of the first evaporator or the second evaporator, the conduit configured around the other of the first evaporator or the second evaporator such that heat exchange occurs between the refrigerant flowing through the conduit and the other of the first evaporator or the second evaporator.

In another embodiment, a refrigerator appliance is disclosed. The refrigerator appliance includes a fresh food compartment, a frozen food compartment, and a refrigeration system. The refrigeration system includes a compressor for compressing a refrigerant, a condenser downstream of the compressor for receiving the refrigerant from the compressor and condensing the refrigerant, a first evaporator configured for cooling the fresh food compartment, and a second evaporator configured for cooling the frozen food compartment. The refrigeration system further includes a conduit for flowing the refrigerant through one of the first evaporator or the second evaporator, the conduit configured around the other of the first evaporator or the second evaporator such that heat exchange occurs between the refrigerant flowing through the conduit and the other of the first evaporator or the second evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
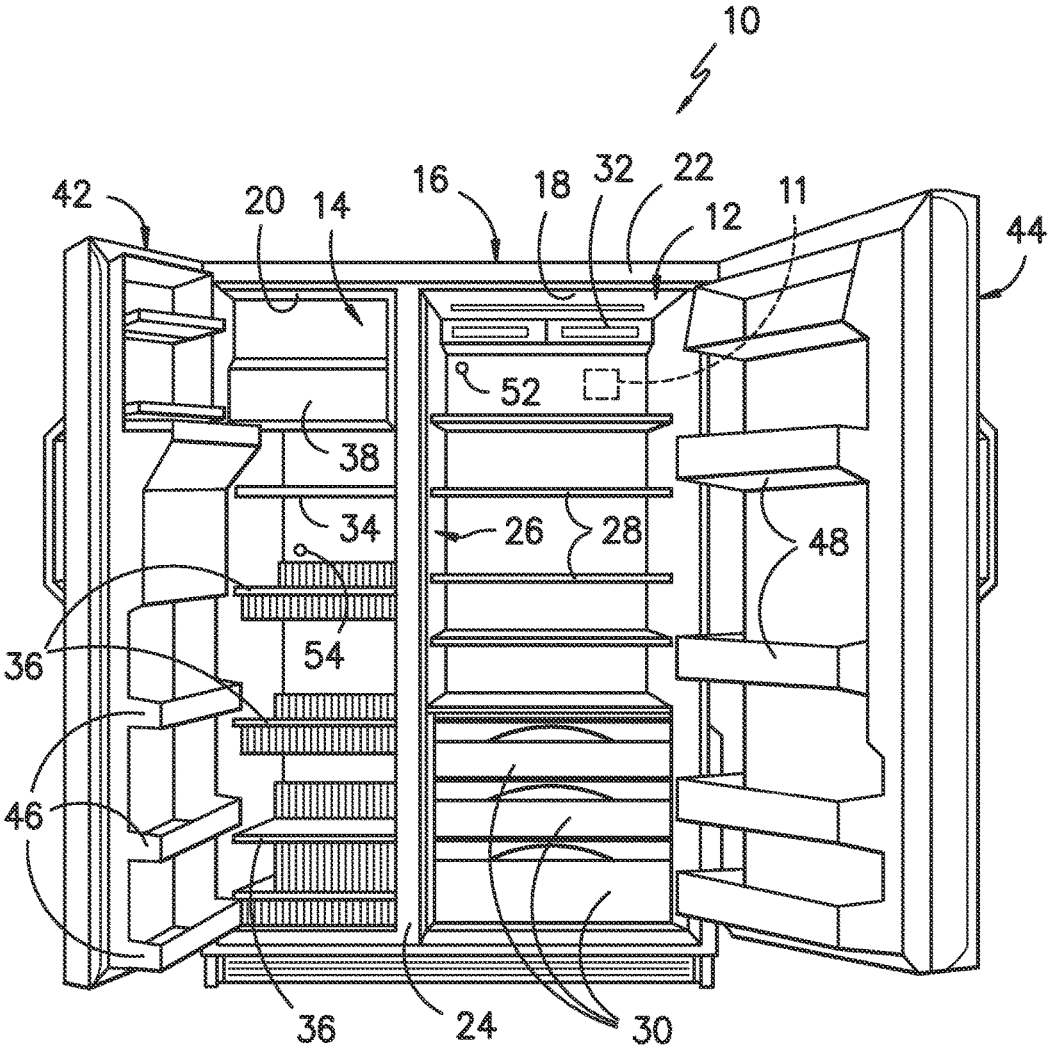
FIG. 1 provides an exemplary embodiment of a refrigerator appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a representative refrigerator appliance 10 in an exemplary embodiment of the present invention. More specifically, for illustrative purposes, the present invention is described with a refrigerator appliance 10 having a construction as shown and described further below. As used herein, a refrigerator appliance includes appliances such as a refrigerator/freezer combination, side-by-side, bottom mount, compact, and any other style or model of a refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming and/or user preference via manipulation of a control interface 32 mounted e.g., in an upper region of fresh food storage compartment 12 and connected with the controller. The controller may include one or more memory devices and one or more microprocessors, such as a general or special purpose microprocessor operable to execute programming instructions or micro-control code associated with the operation of the refrigerator appliance. The memory may represent random access memory such as DRAM, or read only memory such as ROM or FLASH. In one embodiment, the processor executes programming instructions stored in memory. The memory may be a separate component from the processor or may be included onboard within the processor. The controller may include one or more proportional-integral (PI) controllers programmed, equipped, or configured to operate the refrigerator appliance according to exemplary aspects of the control methods set forth herein. Accordingly, as used herein, "controller" includes the singular and plural forms.

The controller may be positioned in a variety of locations throughout refrigerator appliance 10. In the illustrated embodiment, the controller may be located e.g., behind an interface panel 32 or doors 42 or 44. Input/output ("I/O") signals may be routed between the control system and various operational components of refrigerator appliance 10 along wiring harnesses that may be routed through e.g., the back, sides, or mullion 26. Typically, through user interface panel 32, a user may select various operational features and modes and monitor the operation of refrigerator appliance 10. In one embodiment, the user interface panel may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. The user interface panel may be in communication with the controller via one or more signal lines or shared communication busses.

In one exemplary embodiment of the present invention, one or more temperature sensors are provided to measure the temperature in the fresh food compartment 12 and the temperature in the freezer compartment 14. For example, first temperature sensor 52 may be disposed in the fresh food compartment 12, and may measure the temperature in the fresh food compartment 12. Second temperature sensor 54 may be disposed in the freezer compartment 14, and may measure the temperature in the freezer compartment 14. This temperature information can be provided, e.g., to the controller 11 for use in operating refrigerator 10 as will be more fully discussed below. These temperature measurements may be taken intermittently or continuously during operation of the appliance and/or execution of a control system as further described below.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
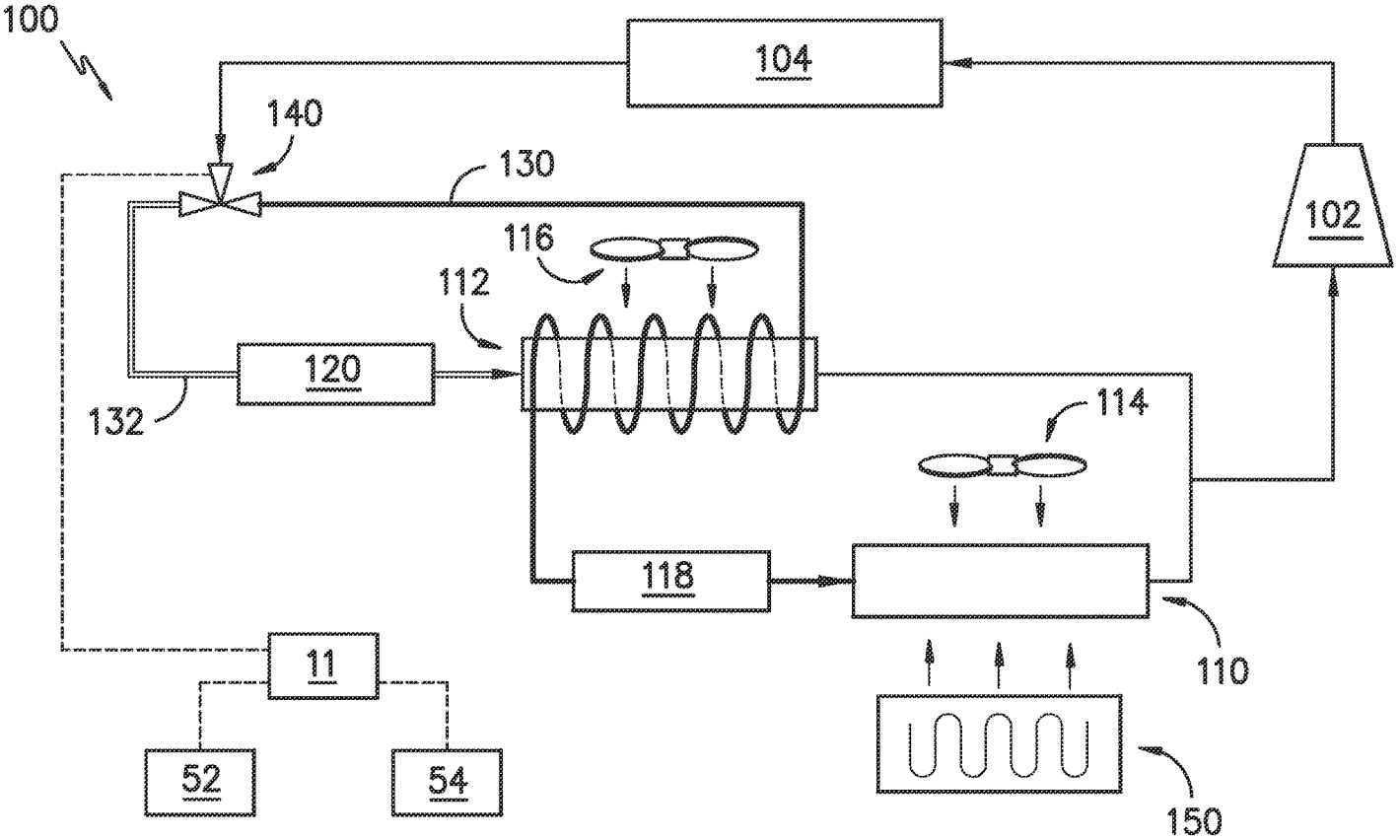
FIG. 2 provides a schematic diagram of a refrigeration system in accordance with one embodiment of the present disclosure.
Figure 3:
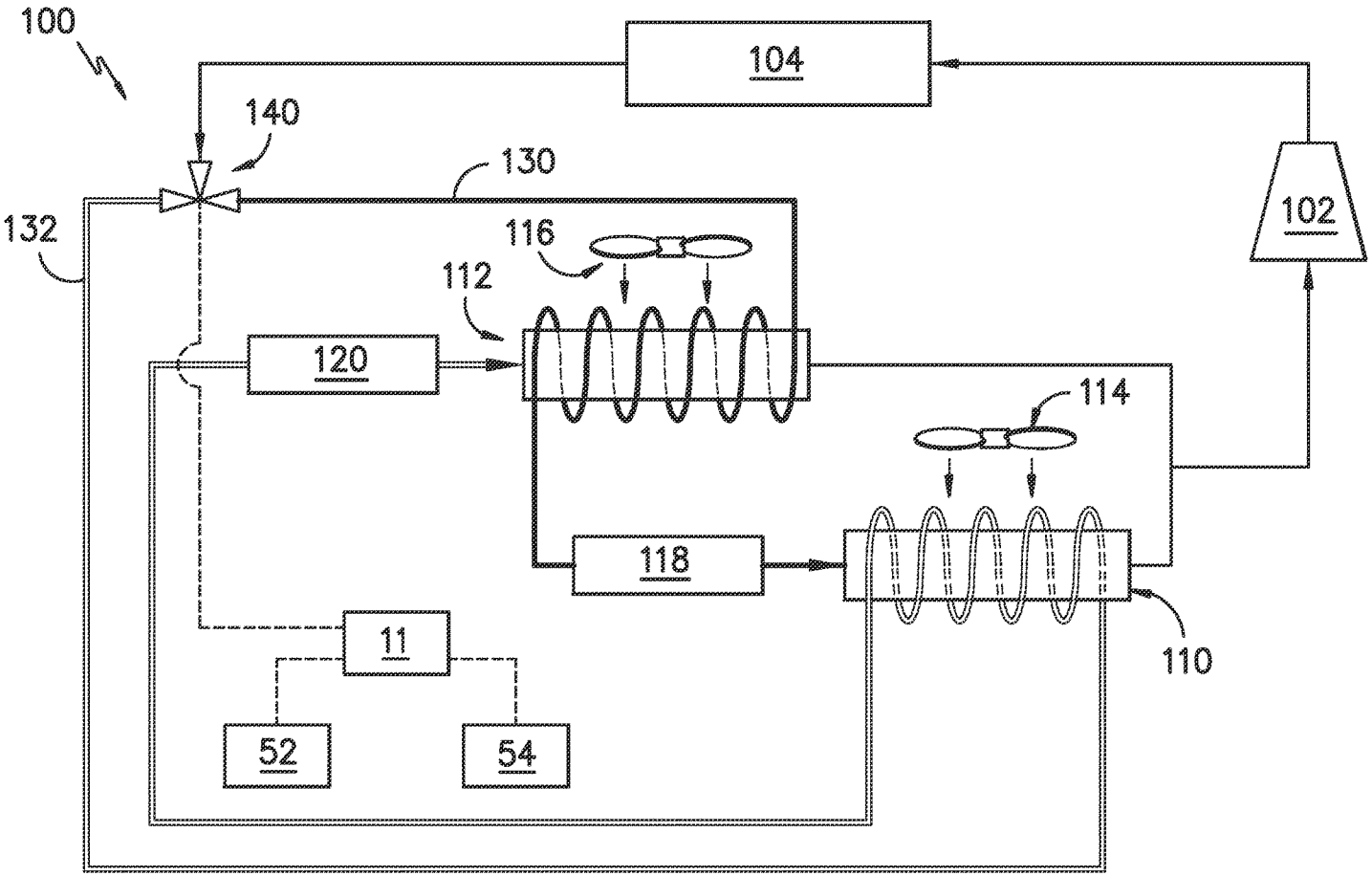
FIG. 3 provides a schematic diagram of a refrigeration system in accordance with another embodiment of the present disclosure.

Referring now to FIGS. 2 and 3, refrigerator appliance 10 may include a refrigeration system 100. In general, refrigeration system 100 is charged with a refrigerant which is flowed through various components and which facilitates cooling of the fresh food compartment 12 and the freezer compartment 14. For example, refrigeration system 100 may include a compressor 102 for compressing the refrigerant, as is generally understood, thus raising the temperature and pressure of the refrigerant. Compressor 102 may for example be a variable speed compressor, such that the speed of the compressor 102 can be varied between zero and 100 percent by the controller 11. Refrigeration system 100 may further include a condenser 104. The condenser 104 may be disposed downstream (in the direction of flow of the refrigerant) of the compressor 102. Thus, condenser 104 may receive refrigerant from the compressor 102, and may condense the refrigerant, as is generally understood, by lowering the temperature of the refrigerant flowing therethrough due to for example heat exchange with ambient air. Alternatively, it should be noted that condensation of the refrigerant may occur in some refrigeration systems 100 without a condenser 104, such as in suitably configured conduits extending between the compressor 102 and evaporator(s) as discussed herein.

Refrigeration system 100 may further include a first evaporator 110 and a second evaporator 112, both disposed downstream of the condenser 104. Evaporators 110, 112 generally are heat exchangers that transfer heat from air passing over the evaporator 110, 112 to refrigerant flowing through the evaporators 110, 112, thereby cooling the air and causing the refrigerant to vaporize. Evaporator fans 114, 116 may be used to force air over respective evaporators 110, 112 as illustrated. As such, cooled air is produced and supplied to refrigerated compartments 12, 14 of refrigerator appliance 10. In one exemplary embodiment of the present invention, fans 114, 116 can be variable speed evaporator fans—meaning the speed of fans 114, 116 may be controlled or set anywhere between and including, for example, 0 and 100 percent. The speed of the evaporator fans 114, 116 can be determined by, and communicated to, the evaporator fans 114, 116 by the controller.

One of the evaporators 110, 112 may be in communication with the fresh food compartment 12, while the other is in communication with the freezer compartment 14. For example, evaporator 110 may provide cooled air to the fresh food compartment 12 and evaporator 112 may provide cooled air to the freezer compartment 14, or vice versa. Alternatively, an evaporator 110, 112 may be in communication with any suitable component of the refrigerator appliance 10. For example, in some embodiments, an evaporator 110, 112 may be in communication with ice maker 38, such as with an ice compartment of the ice maker 38. (Alternatively, ice maker 38 may be cooled by the evaporator 110, 112 that is in communication with the freezer compartment 14 or fresh food compartment 12). Other evaporators 110, 112 may be in communication with the fresh food compartment 12 and/or freezer compartment 14, as desired.

It should be understood that the present disclosure is not limited to two evaporators 110, 112. Rather, three, four, five, six or more evaporators may be utilized. The various evaporators may interact with each other to provide selective and alternative defrosting thereof as discussed herein.

From evaporators 110, 112, refrigerant may flows back to and through compressor 102, which may be downstream of the evaporators 110, 112, thus completing a closed refrigeration loop or cycle. Additionally, first and second expansion devices 118, 120 may be utilized to expand the refrigerant, thus further reduce the pressure of the refrigerant, leaving condenser 104 before being flowed to the respective evaporator 110, 112. Expansion devices 118, 120 in exemplary embodiments are disposed downstream of condenser 104 and upstream of the respective evaporators 110, 112.

Various conduits may be provided for flowing the refrigerant through the various other components of the refrigeration system 100. In exemplary embodiments, for example, a conduit, such as a first conduit 130, may be provided for flowing refrigerant through either the first evaporator 110 or the second evaporator 112. In the embodiments illustrated, conduit 130 flows refrigerant through first evaporator 110.

Conduit 130 may further, in exemplary embodiments, be configured around the other of the first evaporator 110 or the second evaporator 112, such as the second evaporator 112 as illustrated. For example, conduit 130 may be in contact with and/or coiled around, or otherwise at least partially surrounding, the other evaporator. Such proximity of the conduit 130 to the other evaporator may advantageously allow heat exchange, such as indirect heat exchange, to occur between the refrigerant flowing through the conduit 130 and this other of the first evaporator 110 or the second evaporator 112. In exemplary embodiments, the associated expansion device 118, 120, such as expansion device 118 in the embodiments illustrated, may be disposed downstream of the other of the first evaporator 110 or the second evaporator 112. Thus, refrigerant flowing through the conduit 130 at the location configured around the other of the first evaporator 110 or the second evaporator 112 may be generally warmer than that other evaporator 110, 112, and may melt or otherwise facilitate removal of frost on the evaporator 110, 112. Such refrigerant may then be flowed through the associated expansion device 118, 120 and through the one of the first evaporator 110 or the second evaporator 112 to cool the air flowed past the one of the first evaporator 110 or the second evaporator 112 and facilitate cooling of the fresh food compartment 12 or freezer compartment 14.

As further illustrated, another conduit, such as a second conduit 132, may be provided for flowing refrigerant through the other of the first evaporator 110 or the second evaporator 112. In the embodiments illustrated, conduit 132 flows refrigerant through second evaporator 112. As illustrated, a valve 140, such as a three-way valve, may be utilized to flow refrigerant from the condenser 104 to either the first conduit 130 or the second conduit 132. Valve 140 may thus be operable to selectively and, as desired, alternatively, flow refrigerant to one of the first conduit 130 or second conduit 132. Valve 140 may in exemplary embodiments as illustrated be disposed downstream of the compressor 102 and condenser 104, and upstream of the first evaporator 110 and second evaporator 112. Valve 140 may further be disposed upstream of the first expansion device 118 and second expansion device 120, as illustrated, such that refrigerant may be selectively flowed from valve 140 through either the first expansion device 118 and the first evaporator 110 or the second expansion device 120 and the second evaporator 112.

Referring to FIG. 2, in some embodiments, while first conduit 130 is utilized to defrost the other of the first evaporator 110 or the second evaporator 112, a heater 150 may be utilized to defrost the one of the first evaporator 110 or the second evaporator 112 to which first conduit 130 flows the refrigerant. Heater 150 may thus be configured for heating the one of the first evaporator 110 or the second evaporator 112. Heater 150 may be selectively operable, and may operate for example when refrigerant is being flowed through the other of the first evaporator 110 or the second evaporator 112, to reduce frost on the one of the first evaporator 110 or the second evaporator 112.

Referring to FIG. 3, in other embodiments, conduit 132 may further, in exemplary embodiments, be configured around the one of the first evaporator 110 or the second evaporator 112, such as the first evaporator 110 as illustrated. For example, conduit 132 may be in contact with and/or coiled around, or otherwise at least partially surrounding, the evaporator. Such proximity of the conduit 132 to the evaporator may advantageously allow heat exchange, such as indirect heat exchange, to occur between the refrigerant flowing through the conduit 132 and this one of the first evaporator 110 or the second evaporator 112. In exemplary embodiments, the associated expansion device 118, 120, such as expansion device 120 in the embodiments illustrated, may be disposed downstream of the one of the first evaporator 110 or the second evaporator 112. Thus, refrigerant flowing through the conduit 132 at the location configured around the one of the first evaporator 110 or the second evaporator 112 may be generally warmer than that evaporator 110, 112, and may melt or otherwise facilitate removal of frost on the evaporator 110, 112. Such refrigerant may then be flowed through the associated expansion device 118, 120 and through the other of the first evaporator 110 or the second evaporator 112 to cool the air flowed past the other of the first evaporator 110 or the second evaporator 112 and facilitate cooling of the fresh food compartment 12 or freezer compartment 14.

As discussed, the first temperature sensor 52 and the second temperature sensor 54 may be disposed in the fresh food compartment 12 and freezer compartment, respectively, for measuring the temperatures therein. Sensors 52, 54 may further be in operative communication with refrigeration system 100, such as with the valve 140 or other suitable components. Refrigeration system 100 may thus operate based on temperature data obtained from the sensors 52, 54. Such operative communication may, for example, be through controller 11, which may be in operative communication with valve 140 and/or other suitable components, such as first and second evaporators 110, 112. For example, sensors 52, 54 may communicate temperature data to controller 11. When the temperature in the fresh food compartment 12 or the freezer compartment 14 reaches a predetermined threshold (which may for example be user determined), the controller 11 may send signals to operate various system 100 components to cool that compartment. In particular, controller 11 may send signals to valve 140 to flow refrigerant through either the first conduit 130 or the second conduit 132, depending on which compartment 12, 14 requires cooling. Further, if both compartments require cooling, controller 11 may send signals to valve 140 to flow refrigerant first to one conduit 130, 132, and then to the other conduit 130, 132, such that the compartments 12, 14 are selectively and alternatively cooled. Accordingly, the first evaporator 110 and the second evaporator 112 may be selectively and alternatively operable, such as by the controller 11 and based on temperature data, to cool compartments 12 and 14.

Refrigeration systems 100 according to the present disclosure thus advantageously facilitate reductions or elimination of frost on evaporators such as evaporators 110, 112, thus increasing evaporator efficiency while reducing system 100 cost and complexity. Such advantages are facilitated by the arrangement of conduits which flow refrigerant to one evaporator while be configured around another evaporator, facilitating heating of the other evaporator during cooling operations of the first. Selective and alternative operation of dual evaporator can advantageously facilitate selective and alternative defrosting of the evaporators, such that minimal or no frost is develops on the evaporators during system 100 and appliance 10 operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration system for a refrigerator appliance, the refrigeration system comprising:

a compressor for compressing a refrigerant;

a first evaporator;

a second evaporator;

a first conduit for flowing the refrigerant through one of the first evaporator or the second evaporator, the first conduit including a first coil disposed upstream from the one of the first evaporator or the second evaporator, the first coil being positioned around the other of the first evaporator or the second evaporator such that heat exchange occurs between the refrigerant flowing through the first conduit at the first coil and the other of the first evaporator or the second evaporator; and a second conduit for flowing the refrigerant through the other of the first evaporator or the second evaporator, the second conduit including a second coil disposed upstream from the one of the first evaporator or the second evaporator, the second coil being positioned around the one of the first evaporator or the second evaporator such that heat exchange occurs between the refrigerant flowing through the second conduit at the second coil and the one of the first evaporator or the second evaporator.

2. The refrigeration system of claim 1, further comprising an expansion device disposed upstream of the one of the first evaporator or the second evaporator for expanding the refrigerant before the refrigerant is flowed through the one of the first evaporator or the second evaporator.

3. The refrigeration system of claim 2, wherein the expansion device is disposed downstream of the other of the first evaporator or the second evaporator, and wherein the expansion device is disposed downstream of the first coil.

4. The refrigeration system of claim 1, further comprising a valve operable to selectively flow refrigerant to the first conduit or the second conduit.

5. The refrigeration system of claim 4, wherein the valve is disposed downstream of the compressor and upstream of the first evaporator and the second evaporator.

6. The refrigeration system of claim 4, wherein the valve is a three-way valve.

7. The refrigeration system of claim 1, further comprising an expansion device disposed upstream of the other of the first evaporator or the second evaporator for expanding the refrigerant before the refrigerant is flowed through the other of the first evaporator or the second evaporator.

8. The refrigeration system of claim 7, wherein the expansion device is disposed downstream of the one of the first evaporator or the second evaporator.

9. The refrigeration system of claim 1, further comprising a heater configured for heating the one of the first evaporator or the second evaporator.

10. The refrigeration system of claim 1, wherein the first evaporator and the second evaporator are selectively and alternately operable.

11. A refrigerator appliance, the refrigerator appliance comprising:

a fresh food compartment;

a frozen food compartment; and a refrigeration system, comprising a compressor for compressing a refrigerant, a condenser downstream of the compressor for receiving the refrigerant from the compressor and condensing the refrigerant, a first evaporator configured for cooling the fresh food compartment, a second evaporator configured for cooling the frozen food compartment, a first conduit for flowing the refrigerant through one of the first evaporator or the second evaporator, the first conduit including a first coil disposed upstream from the one of the first evaporator or the second evaporator, the first coil being positioned around the other of the first evaporator or the second evaporator such that heat exchange occurs between the refrigerant flowing through the first conduit at the first coil and the other of the first evaporator or the second evaporator, and a second conduit for flowing the refrigerant through the other of the first evaporator or the second evaporator, the second conduit including a second coil disposed upstream from the one of the first evaporator or the second evaporator, the second coil being positioned around the one of the first evaporator or the second evaporator such that heat exchange occurs between the refrigerant flowing through the second conduit at the second coil and the one of the first evaporator or the second evaporator.

12. The refrigerator appliance of claim 11, further comprising an expansion device disposed upstream of the one of the first evaporator or the second evaporator for expanding the refrigerant before the refrigerant is flowed through the one of the first evaporator or the second evaporator, and wherein the expansion device is disposed downstream of the first coil.

13. The refrigerator appliance of claim 11, further comprising a valve operable to selectively flow refrigerant to the first conduit or the second conduit.

14. The refrigerator appliance of claim 11, further comprising an expansion device disposed upstream of the other of the first evaporator or the second evaporator for expanding the refrigerant before the refrigerant is flowed through the other of the first evaporator or the second evaporator.

15. The refrigerator appliance of claim 11, further comprising a heater configured for heating the one of the first evaporator or the second evaporator.

16. The refrigerator appliance of claim 11, further comprising a first temperature sensor disposed in the fresh food compartment and a second temperature sensor disposed in the frozen food compartment, the first and second temperature sensors in operative communication with the refrigeration system.

17. A refrigerator appliance, the refrigerator appliance comprising:

a fresh food compartment;

a frozen food compartment; and a refrigeration system, comprising a compressor for compressing a refrigerant, a condenser downstream of the compressor for receiving the refrigerant from the compressor and condensing the refrigerant, a first evaporator configured for cooling the fresh food compartment, a second evaporator configured for cooling the frozen food compartment, a first conduit for flowing the refrigerant through one of the first evaporator or the second evaporator, the first conduit including a first coil disposed upstream from the one of the first evaporator or the second evaporator, the first coil being positioned around the other of the first evaporator or the second evaporator such that heat exchange occurs between the refrigerant flowing through the first conduit at the first coil and the other of the first evaporator or the second evaporator, a second conduit for flowing the refrigerant through the other of the first evaporator or the second evaporator, the second conduit including a second coil disposed upstream from the one of the first evaporator or the second evaporator, the second coil being positioned around the one of the first evaporator or the second evaporator such that heat exchange occurs between the refrigerant flowing through the second conduit at the second coil and the one of the first evaporator or the second evaporator, a valve operable to selectively flow refrigerant to the first conduit or the second conduit, and an first expansion device disposed upstream of the one of the first evaporator or the second evaporator for expanding the refrigerant before the refrigerant is flowed through the one of the first evaporator or the second evaporator, wherein the first expansion device is disposed downstream of the first coil.

18. The refrigerator appliance of claim 17, further comprising a second expansion device disposed upstream of the other of the first evaporator or the second evaporator for expanding the refrigerant before the refrigerant is flowed through the other of the first evaporator or the second evaporator.

19. The refrigerator appliance of claim 17, further comprising a heater configured for heating the one of the first evaporator or the second evaporator.

20. The refrigerator appliance of claim 17, further comprising a first temperature sensor disposed in the fresh food compartment and a second temperature sensor disposed in the frozen food compartment, the first and second temperature sensors in operative communication with the refrigeration system.

* * * * *